US005893561A

United States Patent [19]

Hoffman

[11] Patent Number: 5,893,561

[45] Date of Patent: Apr. 13, 1999

[54] MUSIC TRIVIA GAME

[76] Inventor: Hannah W. Hoffman, 7618 Montgomery Ave., Melrose Park, Pa. 19027

[21] Appl. No.: 09/019,022

[22] Filed: Feb. 5, 1998

[51] Int. Cl.[6] ..... A63F 3/00

[52] U.S. Cl. ..... 273/243; 273/431

[58] Field of Search ..... 273/272, 243, 273/248, 249, 430, 431

[56] References Cited

U.S. PATENT DOCUMENTS

| | | | |
|---|---|---|---|
| 4,787,639 | 11/1988 | Ross | 273/249 |
| 4,889,345 | 12/1989 | Wawzyk | 273/249 |
| 4,998,736 | 3/1991 | Elrod | 273/249 |
| 5,067,721 | 11/1991 | Hart | 273/243 |
| 5,083,794 | 1/1992 | Santagata | 273/249 |
| 5,131,663 | 7/1992 | Klein | 273/243 X |
| 5,660,389 | 8/1997 | Freda, III | 273/431 X |
| 5,735,522 | 4/1998 | Sausa | 273/431 X |

*Primary Examiner*—William E. Stoll

[57] ABSTRACT

A new music trivia game for drawing on knowledge of music to answer music trivia questions. The inventive device includes a game board having a path of travel defined thereon. A plurality of question cards are provided having questions and corresponding answers related to spaces on the game board. Each of the question cards has musical questions arranged in categories of decades. The questions further relate to titles of songs, artists who sing the songs and lyrics of the songs. A playing die and a plurality of playing pieces are also included.

8 Claims, 2 Drawing Sheets

FIG 1
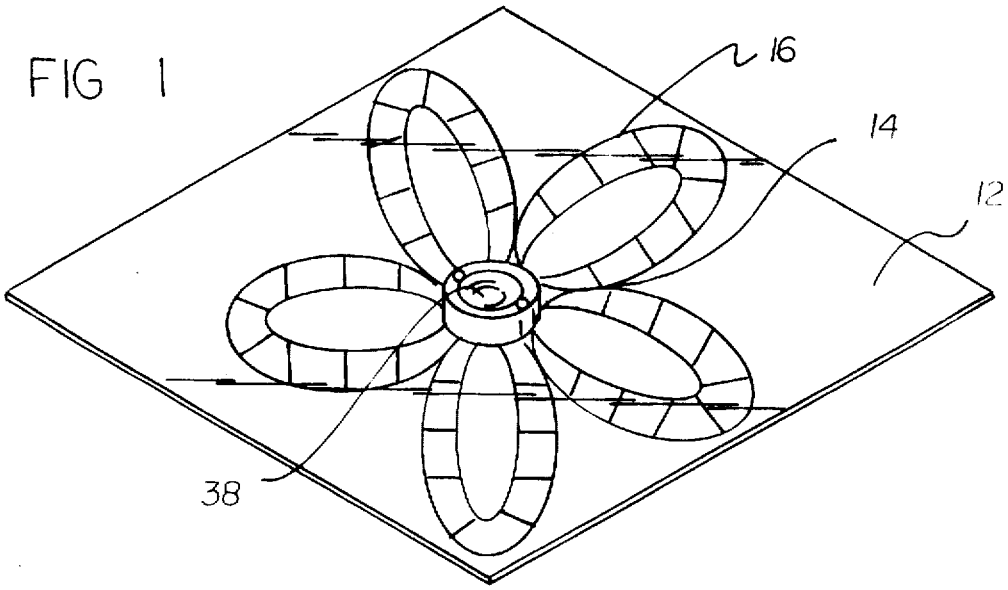
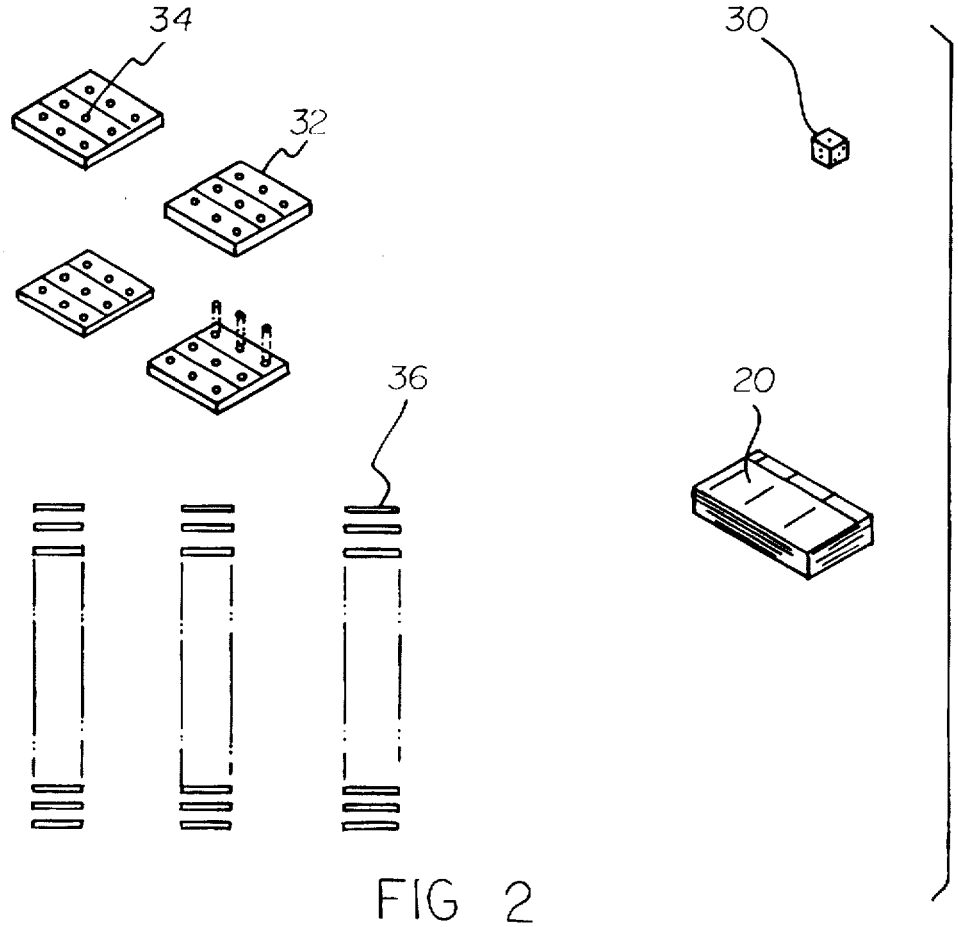
FIG 2

| DECADE | TITLE | ARTIST | NEXT LINE |
|---|---|---|---|
| 50 | QUES. | QUES. | QUES. |
| 60 | | | |
| 70 | | | |
| 80 | | | |
| 90 | | | |

24 20 28 22 26

| | | | |
|---|---|---|---|
| 50 | ANSW. | ANSW. | ANSW. |
| 60 | | | |
| 70 | | | |
| 80 | | | |
| 90 | | | |

20

MUSIC TRIVIA GAME

BACKGROUND OF THE INVENTION

1. Field of the Invention

The present invention relates to trivia board games and more particularly pertains to a new music trivia game for drawing on knowledge of music to answer music trivia questions.

2. Description of the Prior Art

The use of trivia board games is known in the prior art. More specifically, trivia board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art trivia board games include U.S. Pat. No. 4,856,780 to Begley et al.; U.S. Pat. No. 5,377,990 to Seeney-Sullivan; U.S. Pat. No. 4,907,808 to Turner et al.; U.S. Pat. No. 5,083,794 to Santagata; U.S. Pat. No. 5,048,842 to Proctor; and U.S. Pat. No. Des. 359,077 to Larsen.

While these devices fulfill their respective, particular objectives and requirements, the aforementioned patents do not disclose a new music trivia game. The inventive device includes a game board having a path of travel defined thereon. A plurality of question cards are provided having questions and corresponding answers related to spaces on the game board. Each of the question cards has musical questions arranged in categories of decades. The questions further relate to titles of songs, artists who sing the songs and lyrics of the songs. A playing die and a plurality of playing pieces are also included.

In these respects, the music trivia game according to the present invention substantially departs from the conventional concepts and designs of the prior art, and in so doing provides an apparatus primarily developed for the purpose of drawing on knowledge of music to answer music trivia questions.

SUMMARY OF THE INVENTION

In view of the foregoing disadvantages inherent in the known types of trivia board games now present in the prior art, the present invention provides a new music trivia game construction wherein the same can be utilized for drawing on knowledge of music to answer music trivia questions.

The general purpose of the present invention, which will be described subsequently in greater detail, is to provide a new music trivia game apparatus and method which has many of the advantages of the trivia board games mentioned heretofore and many novel features that result in a new music trivia game which is not anticipated, rendered obvious, suggested, or even implied by any of the prior art trivia board games, either alone or in any combination thereof.

To attain this, the present invention generally comprises a game board having a path of travel defined thereon. The path of travel is defined by a central location with a plurality of radially attached loops. Each of the loops is defined by a plurality of spaces. Each of the spaces is individually marked to correspond to questions. A plurality of question cards are provided each having questions and corresponding answers related to the spaces on the game board. Each of the question cards have musical questions arranged in categories of decades. The questions further relate to titles of songs, artists who sing the songs and lyrics of the songs. A playing die is provided. A plurality of playing pieces are provided with each having a square configuration. The playing pieces each have three rows of three apertures therein. A plurality of correct answer pegs are adapted for being received within the apertures of the playing pieces. An answer indicator is positioned on the central location of the game board. The answer indicator includes a voice chip within a housing. The housing has a speaker in communication with the voice chip. The housing has a correct answer button and an incorrect button.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new music trivia game apparatus and method which has many of the advantages of the trivia board games mentioned heretofore and many novel features that result in a new music trivia game which is not anticipated, rendered obvious, suggested, or even implied by any of the prior art trivia board games, either alone or in any combination thereof.

It is another object of the present invention to provide a new music trivia game which may be easily and efficiently manufactured and marketed.

It is a further object of the present invention to provide a new music trivia game which is of a durable and reliable construction.

An even further object of the present invention is to provide a new music trivia game which is susceptible of a low cost of manufacture with regard to both materials and labor, and which accordingly is then susceptible of low prices of sale to the consuming public, thereby making such music trivia game economically available to the buying public.

Still yet another object of the present invention is to provide a new music trivia game which provides in the apparatuses and methods of the prior art some of the advantages thereof, while simultaneously overcoming some of the disadvantages normally associated therewith.

Still another object of the present invention is to provide a new music trivia game for drawing on knowledge of music to answer music trivia questions.

Yet another object of the present invention is to provide a new music trivia game which includes a game board having a path of travel defined thereon. A plurality of question cards are provided having questions and corresponding answers related to spaces on the game board. Each of the question cards has musical questions arranged in categories of decades. The questions further relate to titles of songs, artists who sing the songs and lyrics of the songs. A playing die and a plurality of playing pieces are also included.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new music trivia game according to the present invention illustrating the game board thereof.

FIG. 2 is a perspective view of various components of the present invention.

DESCRIPTION OF THE PREFERRED EMBODIMENT

Figures 3, 4, 5:
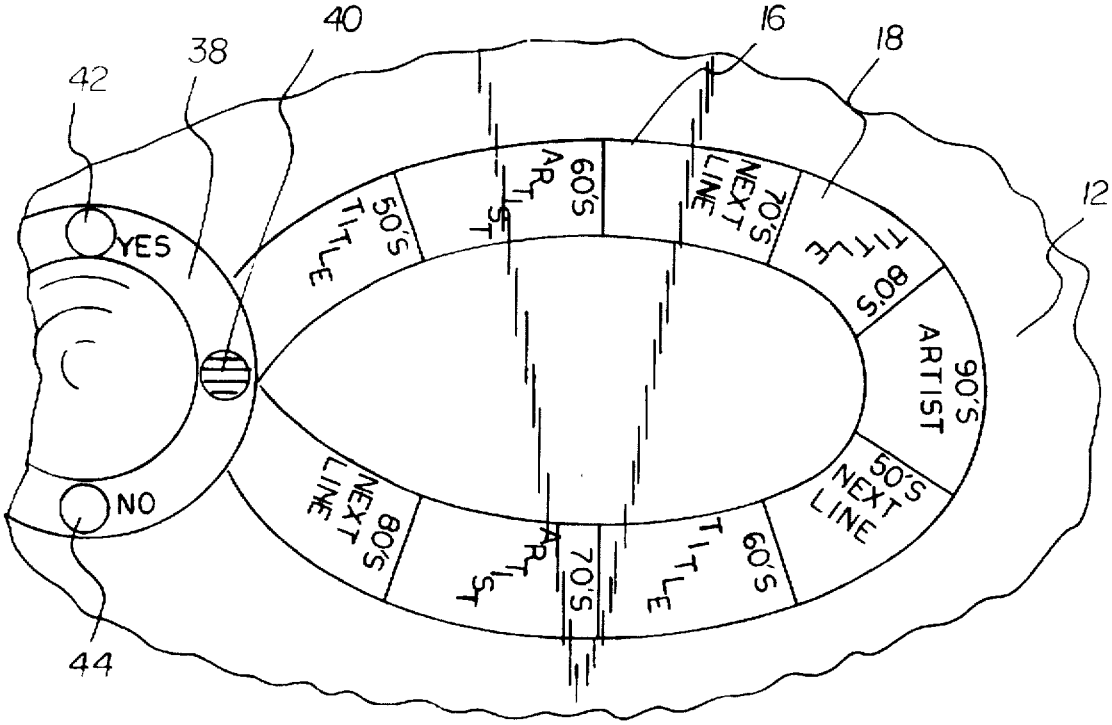
FIG. 3 is a partial top plan view of the game board of the present invention illustrating a loop path thereof.
FIG. 4 is a view of the questions of the cards of the present invention.
FIG. 5 is a view of the answers to the questions of the cards of the present invention.

With reference now to the drawings, and in particular to FIGS. 1 through 5 thereof, a new music trivia game embodying the principles and concepts of the present invention and generally designated by the reference numeral 10 will be described.

As best illustrated in FIGS. 1 through 5, the music trivia game 10 comprises a game board 12 having a path of travel 14 defined thereon. The path of travel 14 is defined by a central location with a plurality of radially attached loops 16. Each of the loops 16 is defined by a plurality of spaces 18. Each of the spaces 18 is individually marked to correspond to questions.

A plurality of question cards 20 are provided each having questions and corresponding answers related to the spaces 18 on the game board 12. Each of the question cards 20 have musical questions arranged in categories of decades 22. The questions further relate to titles of songs 24, artists who sing the songs 26 and lyrics of the songs 28.

A playing die 30 is provided.

A plurality of various colored playing pieces 32 are provided with each having a square configuration. The playing pieces 32 each have three rows of three apertures 34 therein.

A plurality of color-coded correct answer pegs 36 are adapted for being received within the apertures 34 of the playing pieces 32.

An answer indicator 38 is positioned on the central location of the game board 12. The answer indicator 38 includes a voice chip within a housing. The housing has a speaker 40 in communication with the voice chip. The housing has a correct answer button 42 and an incorrect button 44. If a correct answer is given, the correct answer button 42 is pressed to simulate a song with a positive theme. If an incorrect answer is given, the incorrect answer button 44 is pressed to simulate a song with a negative theme.

To play, players would take turns rolling the die 30 and moving their piece 32 the corresponding number of spaces 18 on the game board 12. The player would then answer a question 20 according to the particular space 18 they are on. The object of the game would be to answer a question 20 and receive a color-coded peg 36 for an artist, song, and lyric from each of three decades. On lyric questions, the player would be read a lyric, and then they would have to identify the lyric that follows it. If the answer is correct, they would receive a peg 36 and place it in the corresponding aperture 34 on the playing piece 32. Play would continue in this manner, with players rolling the die 30, moving their piece 32, and answering various musical questions. The first player to fill all his apertures 34, three of each color, on the playing pieces 32 would be the winner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new music trivia game for drawing on knowledge of music to answer music trivia questions comprising, in combination:

a game board having a path of travel defined thereon, the path of travel being defined by a central location with a plurality of radially attached loops, each of the loops being defined by a plurality of spaces, each of the spaces being individually marked to correspond to questions;

a plurality of question cards, each of the question cards having questions and corresponding answers related to the spaces on the game board, each of the question cards having musical questions arranged in categories of decades, the questions further relating to titles of songs, artists who sing the songs and lyrics of the songs;

a playing die;

a plurality of playing pieces each having a square configuration, the playing pieces each having three rows of three apertures therein;

a plurality of correct answer pegs adapted for being received within the apertures of the playing pieces; and an answer indicator positioned on the central location of the game board, the answer indicator including a voice chip within a housing, the housing having a speaker in communication with the voice chip, the housing having a correct answer button and an incorrect button.

2. A new music trivia game for drawing on knowledge of music to answer music trivia questions comprising, in combination:

a game board having a path of travel defined thereon;

a plurality of question cards, each of the question cards having questions and corresponding answers related to spaces on the game board, each of the question cards having musical questions arranged in categories of decades, the questions further relating to titles of songs, artists who sing the songs and lyrics of the songs;

a playing die;

a plurality of playing pieces.

3. The music trivia game as set forth in claim 2 wherein the path of travel is defined by a central location with a plurality of radially attached loops.

4. The music trivia game as set forth in claim 3 wherein each of the loops are defined by a plurality of spaces, each of the spaces are individually marked to correspond to questions.

5. The music trivia game as set forth in claim 2 wherein the playing pieces each have three rows of three apertures therein.

6. The music trivia game as set forth in claim 5 and further including a plurality of correct answer pegs adapted for being received within the apertures of the playing pieces.

7. The music trivia game as set forth in claim in claim 2 and further including an answer indicator positioned on the central location of the game board.

8. The music trivia game as set forth in claim 7 wherein the answer indicator includes a voice chip within a housing, the housing having a speaker in communication with the voice chip, the housing having a correct answer button and an incorrect button.

* * * * *